US005924150A

United States Patent [19]

Workman

[11] Patent Number: 5,924,150

[45] Date of Patent: Jul. 20, 1999

[54] MATTRESS EDGE SUPPORT SPRING AND HANDLE STRUCTURE

[75] Inventor: Joe C. Workman, Carthage, Mo.

[73] Assignee: L&P Property Management Company, South Gate, Calif.

[21] Appl. No.: 09/092,300

[22] Filed: Jun. 5, 1998

[51] Int. Cl.[6] ..... A47C 27/00

[52] U.S. Cl. ..... 5/703; 5/739; 16/DIG. 28

[58] Field of Search ..... 5/703, 717, 739, 5/725, 260; 16/DIG. 28

[56] References Cited

U.S. PATENT DOCUMENTS

| | | | |
|---|---|---|---|
| 2,029,076 | 1/1936 | Leeman | 5/717 X |
| 3,200,417 | 8/1965 | Costello | 5/260 |
| 3,254,350 | 6/1966 | Bronstein, Sr. | 5/703 |
| 3,254,351 | 6/1966 | Bronstein, Sr. | 5/703 |
| 3,590,405 | 7/1971 | Kerr | 5/703 |
| 3,833,950 | 9/1974 | Pappathatos | 5/703 |
| 3,995,337 | 12/1976 | Gershaw | 5/345 B |
| 5,149,064 | 9/1992 | Schulz, Jr. | 267/97 |
| 5,214,810 | 6/1993 | Ward | 5/703 |
| 5,370,373 | 12/1994 | Bruner et al. | 267/97 |

*Primary Examiner*—Michael F. Trettel
*Attorney, Agent, or Firm*—Wood, Herron & Evans, L.L.P.

[57] ABSTRACT

An edge support spring and handle structure is provided for use in mattresses comprising a continuous length of wire bent to have an elongated top portion and a pair of transverse arms extending downwardly and inwardly from the ends of the top portion, and a bottom portion that mirrors the top portion, with each pair of mirrored transverse arms meeting in a loop to form a pair of loops to which a pair of inwardly extending members of a handle attach. The handle is constructed to have an elongated portion for gripping outside the mattress cover and inwardly extending members that attach to the loops in the edge support spring, such that any strain created by use of the handles will be directed to the edge support spring.

23 Claims, 2 Drawing Sheets

MATTRESS EDGE SUPPORT SPRING AND HANDLE STRUCTURE

FIELD OF THE INVENTION

This invention relates generally to bedding mattresses and more specifically to an improved edge support and handle structure therefore.

BACKGROUND OF THE INVENTION

Typically, a mattress comprises a spring core or so-called spring assembly covered on the top and bottom sides by a cushioning pad and encased with an upholstery covering. The spring core is generally comprised of a matrix of coil springs laced together in the top and bottom planes of the springs and surrounded by top and bottom border wires. Additionally, the mattress may have border or edge support springs mounted between the top and bottom border wires to provide additional stiffness or support around the outer border of the mattress. Additionally, one or more handles may be provided on each of opposing sides of the mattress cover to facilitate movement of the mattress.

In normal use, the mattress and coil springs are subjected to increased local loading along the borders of the mattress, which tends to diminish not only the appearance of the mattress, but also the comfort it may provide. For example, sitting on the edge of the bed will depress the top border wire to the point, in time, where it may acquire a permanent deformation. Furthermore, this deformation may result in an uncomfortable tilting or sloping of the bed to one side resulting in a tendency for one lying on the mattress to roll to the low side of the bed.

Border reinforcing springs or edge support springs have been developed in various forms to support the edges of mattresses. However, a common problem with these edge supports is that the edge support spring structures can be relatively "loose" so that movement of the edge supports results in undesirable noise. The noise which results from the use of edge support springs is a result of the fact that the torsional members of the edge support which provide the resilient support are not secured tightly together along their entire length. This enables the torsional members to slip relative to one another during use thereby generating the undesirable noise associated with known edge support springs.

U.S. Pat. No. 5,370,373 describes an edge support spring, commonly referred to in the art as a torsional "fishmouth-shaped" edge support, designed to alleviate the above described problems. The edge support spring comprises a pair of torsional wires, each formed of a length of wire bent to have an elongated center section and transverse arms that extend perpendicular to the elongated center section. The end portions of the transverse arms extend outwardly and are secured to the top and bottom border wires by means of a helical border wire. The center sections of the two torsional wires are also bound to each other by means of a helical lacing wire to prevent translational (longitudinal and lateral) movement relative to one another. U.S. Pat. No. 3,200,417 discloses a similar two torsional spring structure with the difference being that the center sections are bound together with clips rather than helical lacing wires. These two torsional structures permit rotational movement of the transverse arms, such that the center portions pivot relative to one another when a load is applied to the mattress. This provides a "soft firmness," but it is still desirable to provide customers with a line of mattresses having firmer edge support.

The nature of mattress manufacturing is that mattress spring cores, or so-called spring assemblies, are generally manufactured in one facility and then shipped to a second facility where the cores are covered and upholstered. In the course of upholstering the spring core of the mattress at the second facility, accessories such as these edge support springs may be added to the standard core so as to differentiate mattress models or styles. Mattress upholsterers customarily do not have the equipment or the capabilities of the mattress core manufacturer. Therefore, the assembly and installation of the edge support springs must be done with a minimal amount of effort, expertise, or equipment. The two torsional spring structures discussed above have the disadvantage of requiring the second facility to join the torsion wires to each other as well as join each to a border wire. Thus, it is desirable develop edge support springs that limit the effort, expertise, and equipment needed for assembling the mattress.

It is also customary in the manufacture of mattresses to provide handles extending through the cover of the mattress to enable the mattress to be conveniently lifted, moved and turned. These handles typically include a grippable member that extends along the outer surface of the cover on the side of the mattress and a pair of end portions that extend into the mattress through openings in the cover. As described in U.S. Pat. Nos. 5,214,810 and 3,590,405, for example, the end portions are secured to the coil springs through the use of a connecting wire or rod that extends through corresponding turns of the springs. While it is desirable to direct the strain from pulling the handle away from the cover of the mattress, this design has the disadvantage of concentrating the strain on the central convolutions of selected outermost coil springs of the mattress.

Great Britain published patent application No. 2,168,250 describes a mattress configuration having a continuous length of edge support wire to which a handle is attached. The edge support wire is of an undulating or wavy construction so as to provide laterally extending upper sections connected to an upper border wire, laterally extending lower sections connected to a lower border wire and intermediate sections extending obliquely between the upper and lower sections. Periodically around the perimeter of the mattress, the intermediate section further comprises a laterally extending section. The handles are described as being attached to these laterally extending sections. This takes the strain off the inner coil springs and redirects it to the edge support wire. While this edge support wire provides vertical and horizontal support to the mattress and the inner coil springs, it provides less resiliency than the fishmouth-shaped edge support springs.

There is thus a need to provide an edge support configuration that is easy to assemble, that provides a high degree of firmness while retaining some degree of resiliency, and that is adapted to receive a handle such that the amount of strain on the internal springs and on the cover is minimized or eliminated.

SUMMARY OF THE INVENTION

The present invention provides an edge support spring and handle structure for use in mattresses that requires minimal effort, expertise and equipment to assemble due to the one-piece construction of the edge support spring, and that provides firmness and resiliency. The edge support spring is a continuous length of wire bent to have an elongated top portion and a pair of transverse arms extending downwardly and inwardly from the ends of the top portion, and a bottom portion that mirrors the top portion, with each pair of mirrored transverse arms meeting in a loop to form a pair of loops to which a pair of inwardly extending members of the handle attach. The handle is constructed to have an elongated portion for gripping outside the mattress cover and inwardly extending members that easily attach to the loops in the edge support spring after the mattress cover is attached, such that any strain created by use of the handles will be directed to the edge support spring.

In a preferred embodiment of the present invention, the top and bottom portions of the edge support spring lie in a first vertical plane, the transverse arms extend inwardly to a second vertical plane within the interior of the mattress core, and the loop portions extend from the second vertical plane to a third vertical plane between the first and second vertical planes.

These and other objects and advantages of the present invention shall become more apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
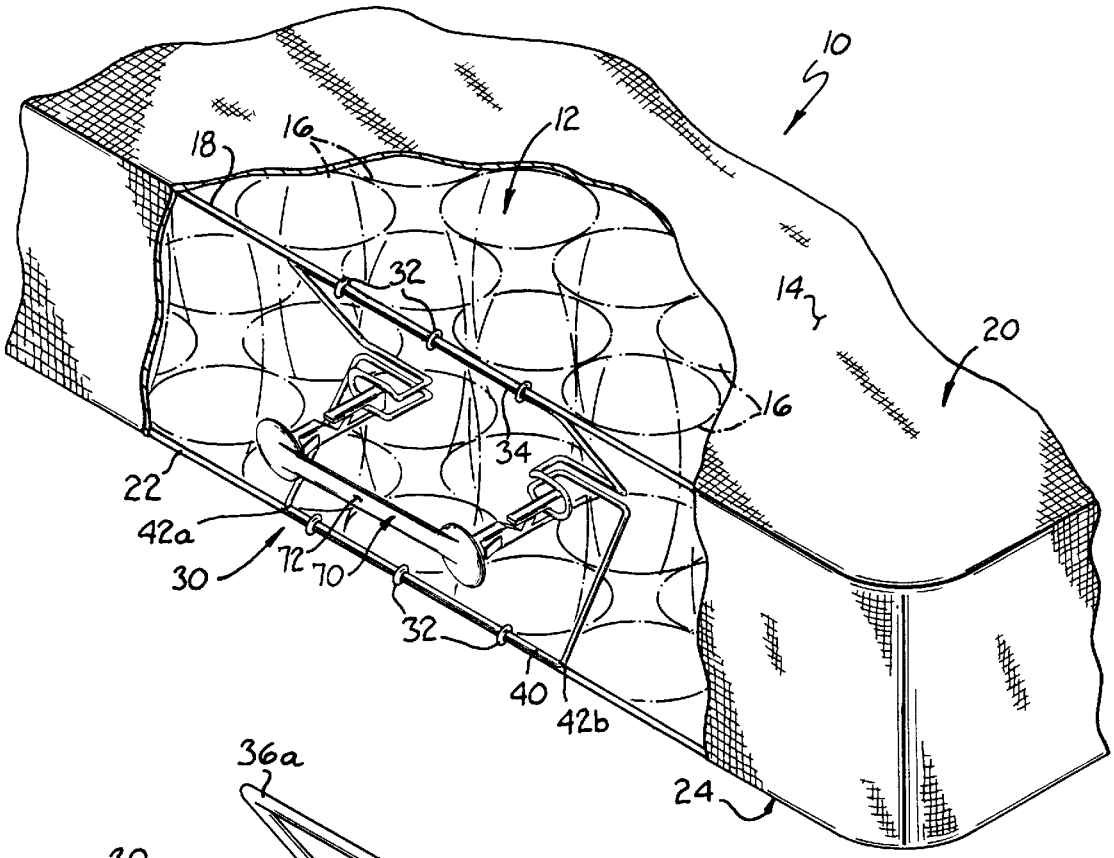
FIG. 1 is a perspective view, partially broken away, of a side portion of a mattress assembly which includes an edge support spring and handle structure of the present invention.

Referring to FIG. 1, there is illustrated a mattress 10, which comprises a spring assembly 12 and an upholstered covering 14 overlying the spring assembly 12. The spring assembly 12 includes a plurality of coiled springs 16 in a matrix, a first border wire 18 in the top plane 20 of mattress 10, and a second border wire 22 in the bottom plane 24 of mattress 10. The first border wire 18 and second border wire 22 are substantially rectangular and are spaced apart by the coiled springs 16. The first border wire 18 and the second border wire 20 are attached to the outer most or peripheral coil springs 16 by any fasteners such as clips or helical lacing wires.

Figure 2:
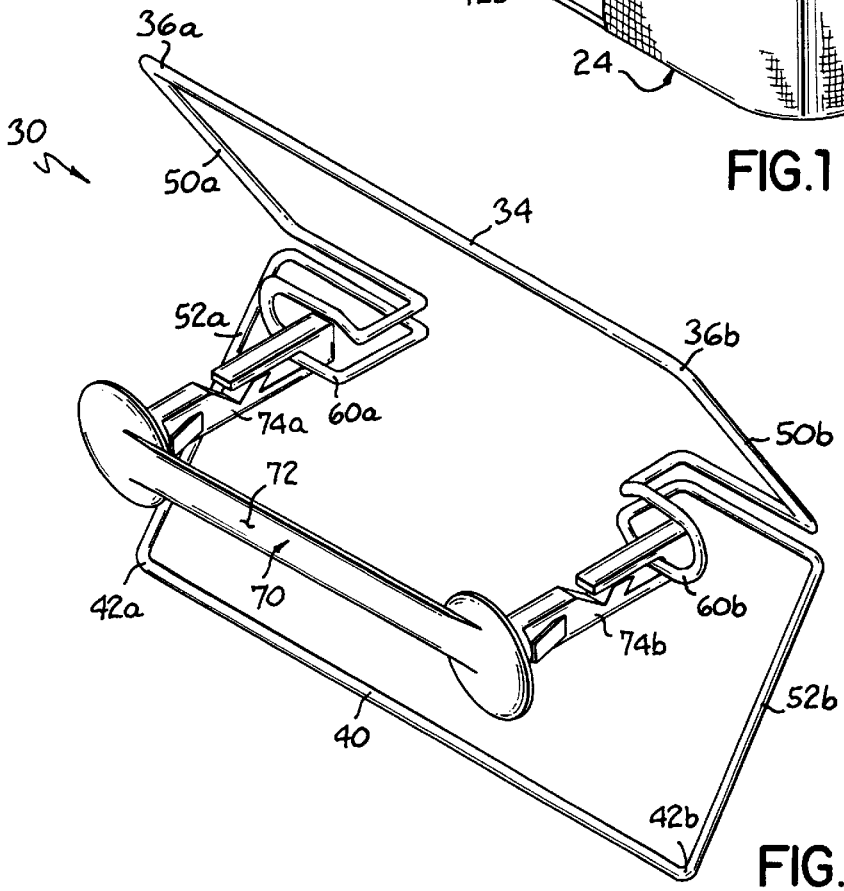
FIG. 2 is an enlarged perspective view of the edge support spring and handle structure of the present invention.

FIG. 1 also shows an edge support spring and handle structure 30 according to the present invention positioned between the first border wire 18 and the second border wire 22. A plurality of edge support spring and handle structures 30 may be spaced around the periphery of the spring assembly 12 as desired. The edge support spring and handle structures 30 may be attached to the first border wire 18 and the second border wire 22 by means of fasteners 32, or any other suitable means. As can be more clearly seen in FIG. 2, each edge support spring and handle structure 30 comprises a continuous length of wire bent to have an elongated top portion 34 with spaced ends 36*a*, 36*b* and an elongated bottom portion 40 with spaced ends 42*a*, 42*b*. Extending downwardly from each end 36*a*, 36*b* of the top portion 34 is a transverse arm 50*a*, 50*b* which in the preferred embodiment of the present invention are generally perpendicular to the elongated top portion 34. Extending upwardly from each end 42*a*, 42*b* of the bottom portion 40 is a transverse arm 52*a*, 52*b* which in a preferred embodiment of the present invention are generally perpendicular to the elongated bottom portion 40.

Transverse arm 50*a* joins respective transverse arm 52*a* in a loop portion 60*a*. Likewise, transverse arm 50*b* joins transverse arm 52*b* in a loop portion 60*b*. In a preferred embodiment of the present invention, these loop portions 60 extend toward each other. A handle 70 comprised of an elongated portion 72 and a pair of inwardly projected members 74*a*, 74*b* is positioned such that the elongated portion 72 is on the outside of the mattress cover 14 and the inwardly projecting members extend through apertures (not shown) in the cover 14 to connect to the loop portions 60*a*, 60*b*.

Figure 3:
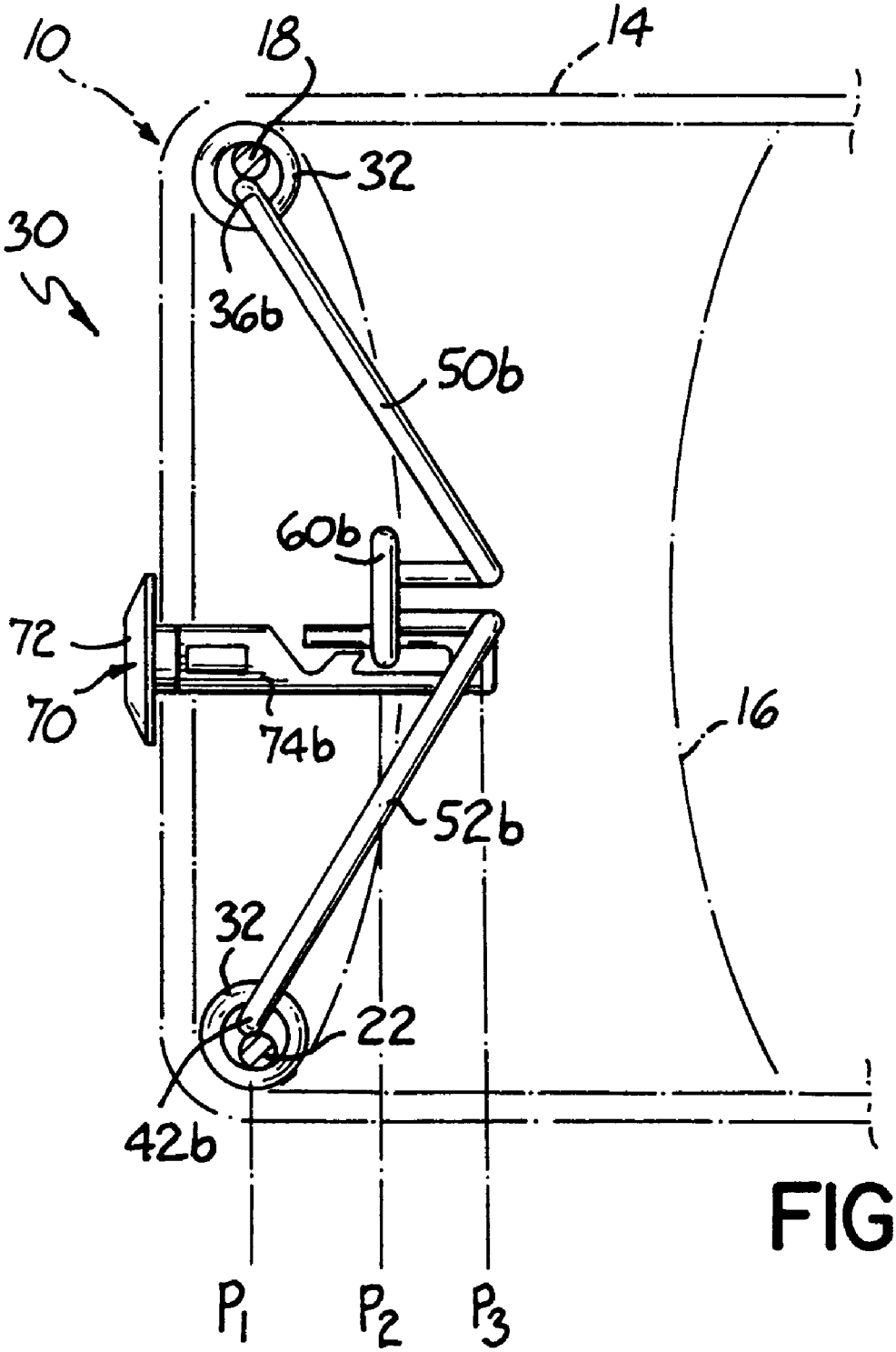
FIG. 3 is a side view of the edge support spring and handle structure attached to upper and lower border wires of the mattress assembly of FIG. 1.

In a preferred embodiment of the present invention, as best shown in FIG. 3, top portion 34 with ends 36*a*, 36*b* and bottom portion 40 with ends 42*a*, 42*b* are in a first vertical plane $P_1$ defining the outermost vertical plane of the mattress spring assembly 12. Transverse arms 50*a*, 50*b* extend downwardly and inwardly toward the coiled springs 16 and transverse arms 52*a*, 52*b* extend upwardly and inwardly toward the coiled springs 16 such that the transverse arms 50*a*, 50*b*, 52*a*, 52*b* end in a second vertical plane $P_2$ within the spring assembly 12. The loop portions 60*a*, 60*b* extend from the transverse arms 50*a*, 50*b* and 52*a*, 52*b* respectively in the second vertical plane $P_2$ to a third vertical plane $P_3$ between the first and second vertical planes $P_1$, $P_2$. The loop portions 60 preferably extend toward each other in the second vertical plane $P_2$ before extending outwardly to the third vertical plane $P_3$ where they extend away from one another in a generally U-shaped configuration when viewed in top plan as may be seen in FIG. 1.

In this preferred embodiment, the strain imparted by the use of the handle 70 is directed to the edge support spring at a point intermediate the mattress cover 14 and the coiled springs 16. This preferred embodiment further provides increased firmness to the mattress structure by eliminating the relative movement in the two torsional structures by use of the continuous length of wire, while maintaining the resiliency of the structure with the use of the fish mouth-shaped configuration.

In accordance with the principals of the present invention the continuous length of wire may be formed by welding or joining by other suitable means two or more lengths of wire. The handle is preferably one known in the art and disclosed in U.S. Pat. No. 5,214,810 incorporated herein by reference, although others may be used as well. The handle of U.S. Pat. No. 5,214,810 has a strap-like hand grippable member with a pair of end portions positioned adjacent a pair of handle receiving grommets positioned in the cover. Secured to each end portion is an elongate connecting member adapted to extend through an adjacent grommet. Each connecting member has a connecting end portion with a longitudinally extending slot and an opening that leads into the slot. The slot is partitioned into a receiving portion and a locking portion by a flexible and resilient finger member that extends substantially transversely across the slot.

This slot configuration enables the loop portion of the edge support spring of the present invention to be inserted through the opening into the slot receiving portion and past the finger member into the slot locking portion. The finger member is operable to prevent the loop portion from moving back to the slot receiving portion, thereby securely connecting the connecting member to the loop portion of the edge support spring.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, the loop portions of the edge support spring may lie in the second vertical plane where the transverse arms end, without extending to a third vertical plane. Alternatively, the transverse arms may extend toward each other in the same vertical plane, with the loop portions extending inward to the interior of the core. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A mattress comprising:

a mattress spring core comprising a plurality of springs, each of the springs having a planar upper portion in a top plane and a planar lower portion in a bottom plane, the planar upper portions of the springs being surrounded by a first border wire in the top plane and the planar lower portions of the springs being surrounded by a second border wire in the bottom plane, the first and second border wires being connected to selected springs of the spring core; and at least one edge support spring secured to the first and second border wires, each edge support spring comprising a continuous length of wire bent to have a top portion with spaced ends disposed adjacent to the first border wire, a bottom portion with spaced ends disposed adjacent to the second border wire, a pair of first transverse arms extending downwardly and inwardly from the spaced ends of the top portion, a pair of second transverse arms extending upwardly and inwardly from the spaced ends of the bottom portion, wherein each first transverse arm joins a respective second transverse arm at a loop portion, the top and bottom portions of the edge support spring being in a first vertical plane, the transverse arms of the edge support spring ending in a second vertical plane, the second vertical plane being inside the first vertical plane;

a cover surrounding the mattress spring core; and at least one handle, each handle having an elongated portion on the outside of the cover and first and second inwardly projecting members that extend through apertures in the cover, wherein the first and second members are connected to the loop portions of the edge support spring.

2. The mattress of claim 1, wherein the second vertical plane is within the mattress spring core and the loop portions of the edge support extend from the second vertical plane to a third vertical plane between the first vertical plane and the second vertical plane.

3. The mattress of claim 2, wherein the loop portions extend away from each other within the third vertical plane.

4. A mattress comprising:

a mattress spring core comprising a plurality of springs arranged in a matrix, the matrix having two opposed outer end rows and two opposed outer side columns around the perimeter of the spring core, each of the springs having a planar upper portion in a top plane and a planar lower portion in a bottom plane;

a first border wire in the top plane secured to the planar upper portions of springs of the two opposed outer end rows and two opposed outer side columns;

a second border wire in the bottom plane secured to the planar lower portions of springs of the two opposed outer end rows and two opposed outer side columns;

at least one edge support spring secured to the first and second border wires, each edge support spring comprising a continuous length of wire bent to have a top portion with spaced ends disposed adjacent to the first border wire, a bottom portion with spaced ends disposed adjacent to the second border wire, a pair of first transverse arms extending downwardly and inwardly from the spaced ends of the top portion, a pair of second transverse arms extending upwardly and inwardly from the spaced ends of the bottom portion, wherein each first transverse arm joins a respective second transverse arm at a loop portion, the top and bottom portions of the edge support spring being located in a first vertical plane, the loop portion being located inside the first vertical plane;

a cover surrounding the mattress spring core; and at least one handle, each handle having an elongated portion on the outside of the cover and first and second inwardly projecting members that extend through apertures in the cover, wherein the first and second members are connected to the loop portions of the edge support spring.

5. The mattress of claim 4, wherein the top and bottom portions of the edge support spring are secured to the first and second border wires in the first vertical plane.

6. The mattress of claim 5, wherein the transverse arms of the edge support spring extend inwardly to a second vertical plane within the mattress spring core and the loop portions of the edge support spring extend from the second vertical plane to a third vertical plane between the first vertical plane and the second vertical plane.

7. The mattress of claim 6, where in the loop portions extend away from each other within the third vertical plane.

8. A combination mattress spring core and handle, the combination comprising a plurality of springs, each of the springs having a planar upper portion in a top plane and a planar lower portion in a bottom plane, the planar upper portions of the springs being surrounded by a first border wire in the top plane and the planar lower portions of the springs being surrounded by a second border wire in the bottom plane, the first and second border wires being connected to selected springs of the spring core; and at least one edge support spring secured to the first and second border wires, each edge support spring comprising a continuous length of wire bent to have a top portion with spaced ends disposed adjacent to the first border wire, a bottom portion with spaced ends disposed adjacent to the second border wire, a pair of first transverse arms extending downwardly and inwardly from the spaced ends of the top portion, a pair of second transverse arms extending upwardly and inwardly from the spaced ends of the bottom portion, wherein each first transverse arm joins a respective second transverse arm at a loop portion, the transverse arms being substantially perpendicular to the top and bottom portions of the edge support spring; and at least one handle, each handle having an elongated portion and first and second inwardly projecting members, wherein the first and second members are connected to the loop portions of the edge support spring.

9. The combination of claim 8, wherein the edge support spring has two loop portions.

10. The combination of claim 9, wherein the handle is releasably connected to the loop portions of the edge support spring.

11. The combination of claim 9, wherein the loop portions extend towards each other.

12. The combination of claim 8, wherein the top and bottom portions of the edge support spring are secured to the first and second border wires in a first vertical plane.

13. The combination of claim 12, wherein the transverse arms of the edge support spring extend inwardly to a second vertical plane within the mattress spring core and the loop portions of the edge support spring extend from the second vertical plane to a third vertical plane between the first vertical plane and the second vertical plane.

14. The combination of claim 13, wherein the loop portions extend away from each other within the third vertical plane.

15. A structure for use in mattresses comprising:

an edge support spring comprising a continuous length of wire bent to have an elongated top portion with spaced ends, a pair of first transverse arms extending downwardly from the spaced ends of the top portion, an elongated bottom portion with spaced ends and a pair of second transverse arms extending upwardly from the spaced ends of the bottom portion, wherein each first transverse arm joins a respective second transverse arm at a loop portion, the transverse arms being substantially perpendicular to the top and bottom portions; and a handle having an elongated portion and a pair of inwardly extending members, each inwardly extending member being adapted to connect to the edge support spring.

16. The structure of claim 15, wherein the loop portions extend towards each other then turn and extend away from each other.

17. The structure of claim 15, wherein the elongated top and bottom portions of the edge support spring are in a first vertical plane and the loop portions extend into a second vertical plane.

18. A structure for use in mattresses comprising:

an edge support spring comprising a continuous length of wire bent to have an elongated top portion with spaced ends, a pair of first transverse arms extending downwardly and inwardly from the spaced ends of the top portion, an elongated bottom portion with spaced ends and a pair of second transverse arms extending upwardly and inwardly from the spaced ends of the bottom portion, wherein each first transverse arm joins a respective second transverse arm at a loop portion, the top and bottom portions being in a first vertical plane and the transverse arms ending in a second vertical plane; and a handle having an elongated portion and a pair of inwardly extending members, each inwardly extending member being adapted to connect to the edge support spring.

19. The structure of claim 18, wherein the edge support spring has two loop portions.

20. The structure of claim 19, wherein the handle is releasably connected to the loop portions of the edge support spring.

21. The structure of claim 19, wherein the loop portions extend towards each other then turn and extend away from each other.

22. The structure of claim 18, wherein the loop portions of the edge support extend from the second vertical plane to a third vertical plane between the first vertical plane and the second vertical plane.

23. The structure of claim 22, wherein the loop portions extend away from each other within the third vertical plane.

* * * * *